US005114212A

United States Patent [19]

Verney et al.

[11] Patent Number: 5,114,212

[45] Date of Patent: May 19, 1992

[54] CHAIR WITH ADJUSTABLE ARM REST

[75] Inventors: Claude Verney; Alex Strassle, both of Kirchberg, Switzerland

[73] Assignee: Intercollection Development S.A., Kirchberg, Switzerland

[21] Appl. No.: 592,731

[22] Filed: Oct. 2, 1990

[30] Foreign Application Priority Data

Oct. 2, 1989 [CH] Switzerland ..... 3579/89
Nov. 9, 1989 [CH] Switzerland ..... 4037/89

[51] Int. Cl.[5] ..... A47C 7/54

[52] U.S. Cl. ..... 297/421; 297/411; 297/417

[58] Field of Search ..... 297/417, 421, 411, 115

[56] References Cited

U.S. PATENT DOCUMENTS 4,131,315 12/1978 Vogtherr ..... 297/421 X
4,703,974 11/1987 Brauning ..... 297/421 X
4,884,846 12/1989 Tobler ..... 297/411
4,938,534 7/1990 Tornero ..... 297/417

FOREIGN PATENT DOCUMENTS 278651 8/1988 European Pat. Off. ..... 297/417
716060 12/1941 Fed. Rep. of Germany ..... 297/421
683556 12/1952 United Kingdom ..... 297/417
2110925 6/1983 United Kingdom ..... 297/417

*Primary Examiner*—Laurie K. Cranmer
*Attorney, Agent, or Firm*—Sughrue, Mion, Zinn, Macpeak & Seas

[57] ABSTRACT

A chair has side units including support members 7, 8 articulated to arm rests 9, 10, respectively pivotally mounted at their distal ends to a horizontal rod 11 disposed below a seat 1 and to a back rest 3. The ends of the support members are bent at an angle of 70° to 90°, and the units can be moved between raised and collapsed positions.

12 Claims, 8 Drawing Sheets

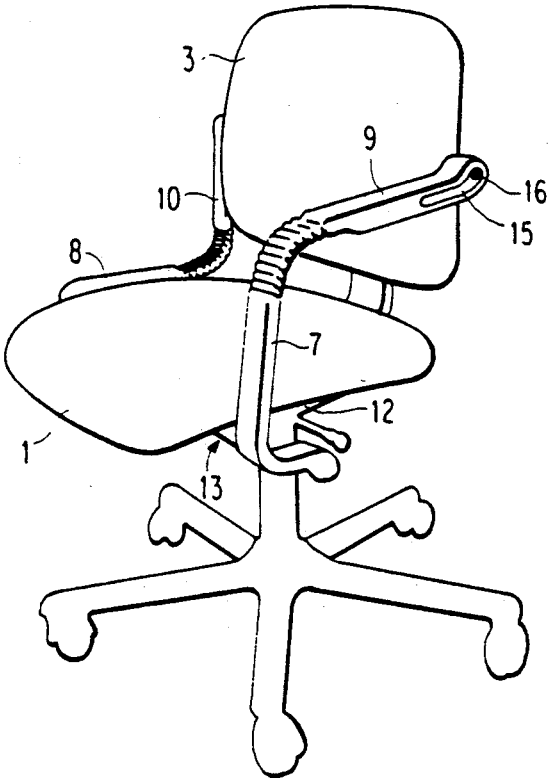
FIG. 5
FIG. 6
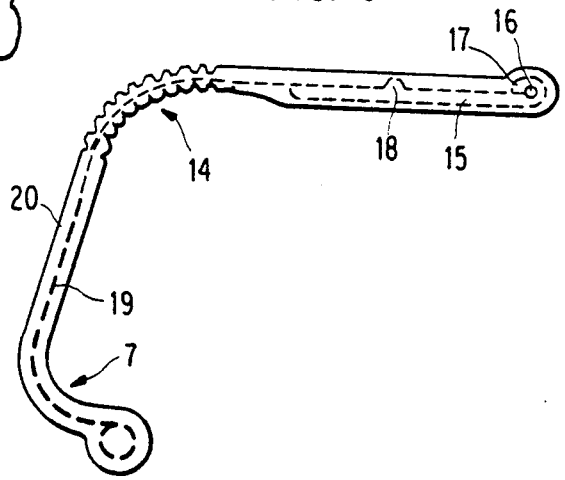
FIG. 7
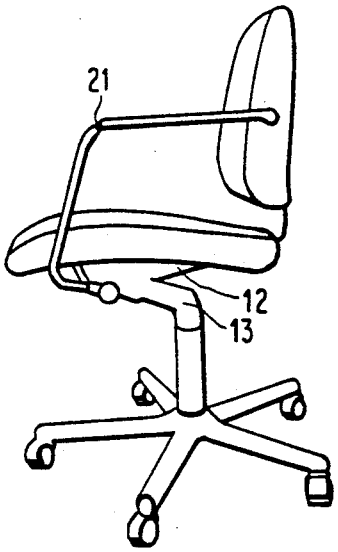

CHAIR WITH ADJUSTABLE ARM REST

BACKGROUND OF THE INVENTION

This invention relates to an easily adjustable arm rest for a chair.

BRIEF DESCRIPTION OF THE DRAWINGS

FIGS. 1 through 5 are perspective views of a chair in accordance with one embodiment of the invention, showing an arm rest(s) in different positions, FIG. 6 is a schematic sectional elevation of the arm rest shown in FIGS. 1 through 5, FIG. 7 is a perspective view of a chair having an arm rest according to another embodiment of the invention.

DETAILED DESCRIPTION OF THE PREFERRED EMBODIMENTS

Figure 1:
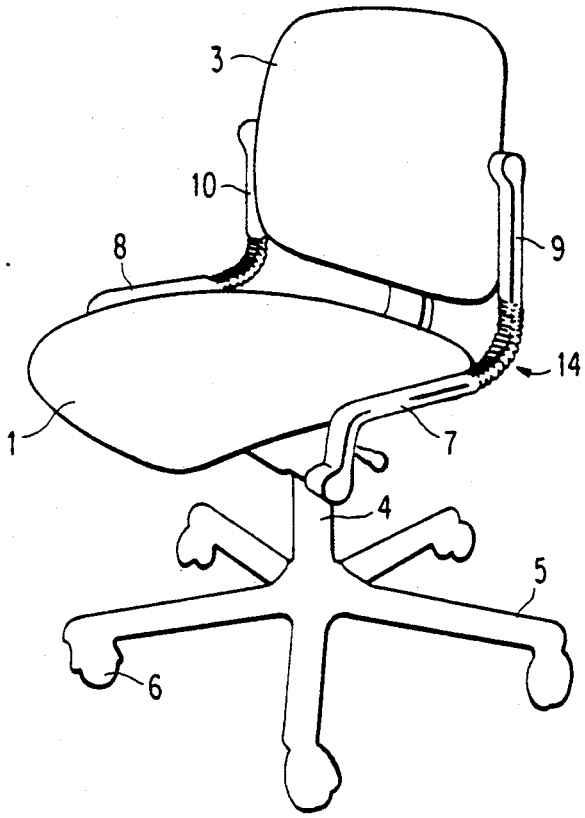

Referring to FIGS. 1 through 5, the illustrated chair comprises a seat holder, which is preferably pivotally hinged, mounting a seat 1 and a back rest 3 secured to a support bar or strap 2. The back rest 3 is preferably vertically adjustable. The seat holder is positioned by a seat carrier in a pedestal 4 having five spider feet 5, whose outer ends are provided with rollers or casters 6. The chair has arm rest support members 7. 8 on its opposite sides, whose lower ends are bent inwardly at an angle of 70° to 90° and articulated to the respective ends of a horizontal shaft 11 mounted on the seat holder, below the seat 1. The other, opposite ends of the support members 7. 8 are respectively articulated to the proximal ends of arm rests g, 10, whose distal ends are pivotally mounted to the opposite sides of the back rest 3.

Thus, the support members 7. B and their associated arm rests 9, 10 form side units that are adjustable or displaceable between two primary positions. In a collapsed or lowered position, illustrated in FIG. 1, the longer portions of the support members are disposed approximately flush with and at a short distance from the seat 1, and the arm rests g, 10 lie approximately flush with and slightly spaced from the back rest 3. The planes of the back rest 3 and the seat 1, and also the longitudinal axes of the arm rests 10 and the support members 7, form an angle of approximately 90°. In the raised position illustrated in FIG. 2 the support members 7, 8 are substantially perpendicular to the plane of the seat 1, and the arm rests g, 10 are approximately perpendicular to the plane of the back rest 3.

Figure 3:
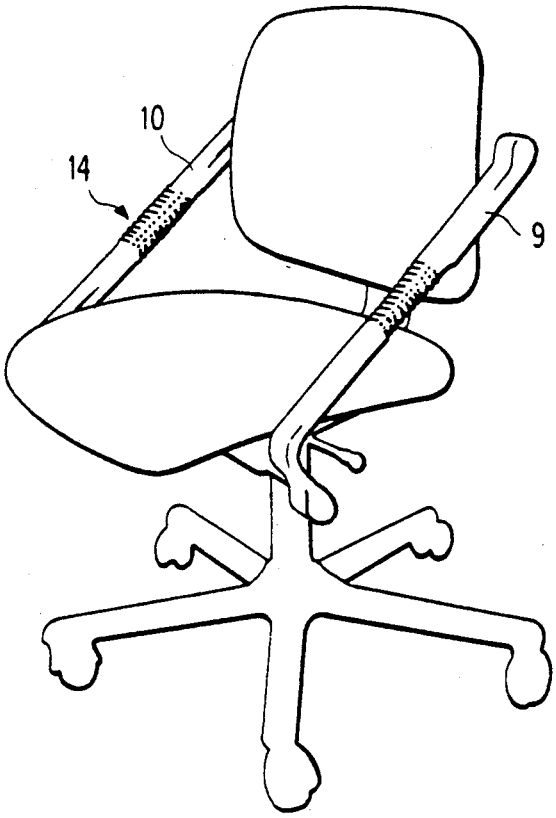
Figure 4:
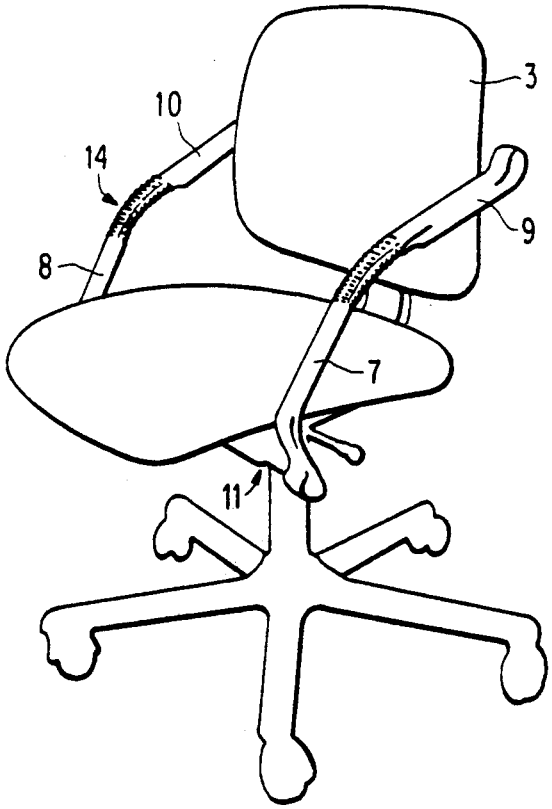

FIGS. 3 and 4 show intermediate positions of the side units constituted by the support members and the arm rests. FIG. 5 shows a chair with each unit in a different primary position, and further illustrates the seat holder 12 and the seat carrier 13. These components are constructed in a known manner in accordance with the prior art, form no part of the invention, and are thus not described in detail.

Figure 2:
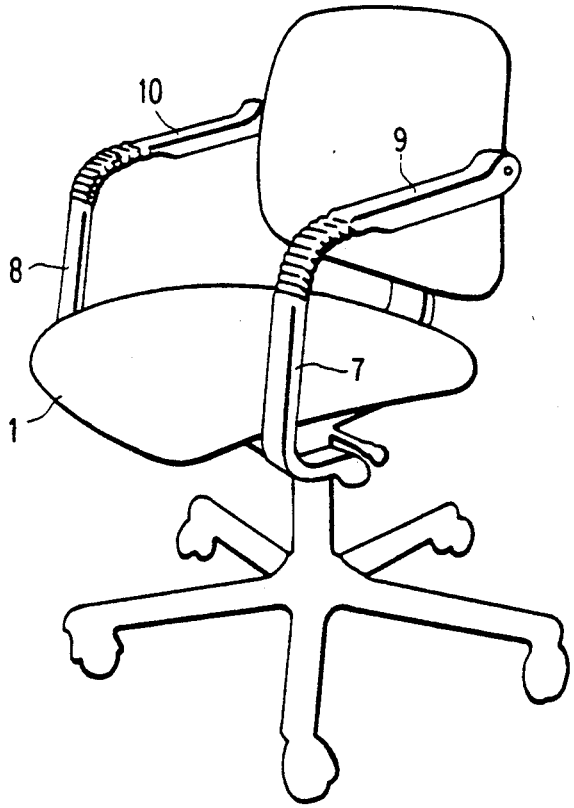

To move the arm rests 9, 10 from the FIG. 1 position to the FIG. 2 position, the articulations 14 are first pulled upwardly such that the support members and arm rests extend in a straight line, as shown in FIG. 3.

The articulations are then pulled forwardly, as shown in FIG. 4, until the arm rests reach the position shown in FIG. 2. Such movements are enabled by slots or grooves 15 in the arm rests, which serve as sliding guides for bolts 16 extending outwardly from the back rest 3. The slots 15 may be T-shaped and the bolts 16 may be provided with matingly configured heads to prevent the arm rests from pulling away. The slots 15 are preferably provided with notches or recesses 17, 18 as shown in FIG. 6, to provide stable seating positions for the bolts 16.

The articulations 14 can be implemented, for example, by embedding an elastic or deformable metal strap 19 in a flexible, preferably lightweight molded component 20, which encases the strap 19 and forms the entire unit including the support member and arm rest.

The articulations 14 can also be implemented by simple hinge joints 21 as illustrated in FIG. 7.

The shaft 11 to which the distal ends of the support members are pivoted is mounted at a distance ranging from 5 to 20 cm below the plane of the seat 1, and preferably about 10 cm below the seat.

In FIGS. 3 and 4 the distal ends of the arm rests project somewhat behind the back rest 3 because the bolts 16 have migrated or been displaced in the slots 16: in the FIG. 4 position the bolts would be disposed in the recesses 18.

Figure 8:
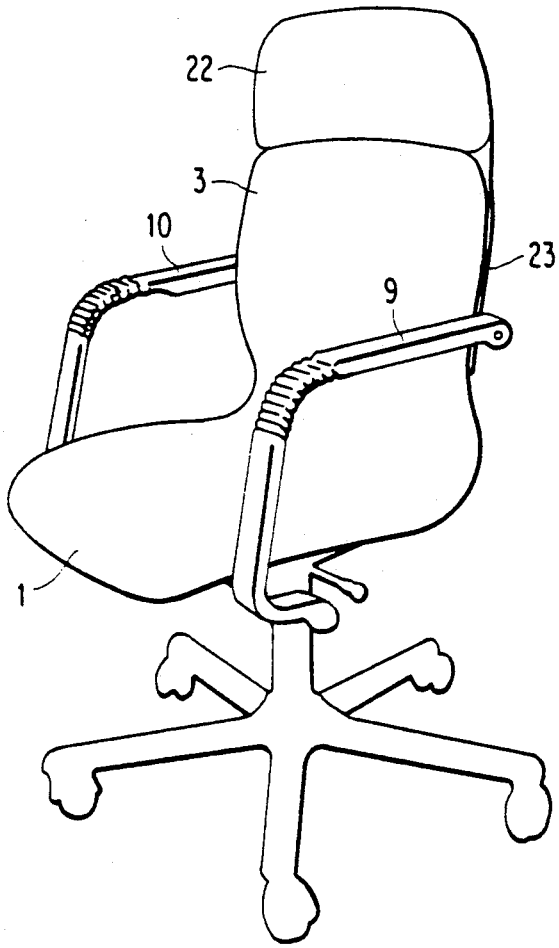
FIGS. 8 through 10 are perspective views of a chair according to a further embodiment of the invention, showing the arm rest(s) in different positions.
Figure 9:
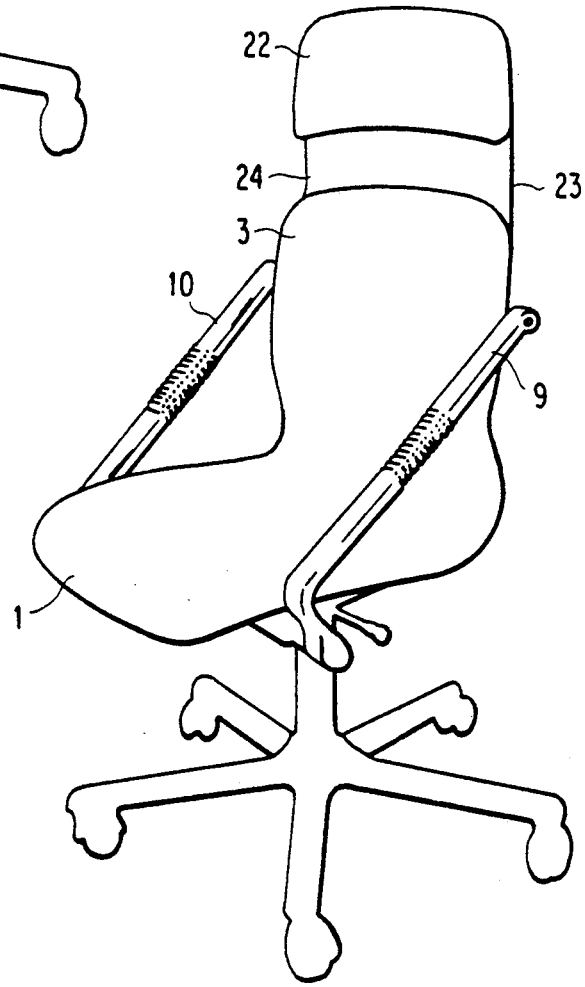
Figure 10:
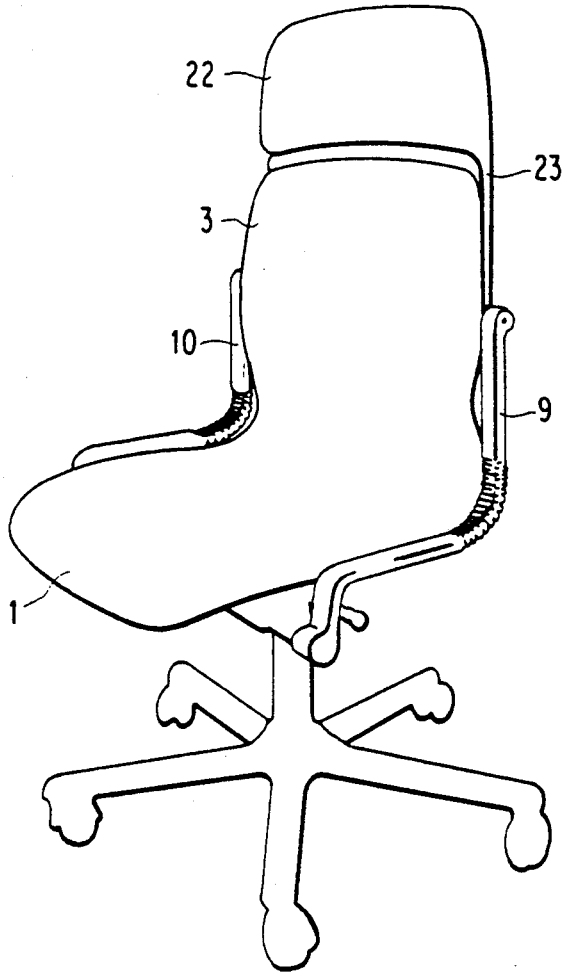

In the embodiment illustrated in FIGS. 8–10 the chair comprises a unitary seat and back rest, and a vertically adjustable head rest 22 mounted to the back rest by support rods 23, 24. In this design or embodiment the distal ends of the arm rests can be pivoted directly to the rods 23, 24, without the slots 15, such that the rods 23, 24 slide upwardly (FIG. 9) and then back down again when the arm rest units are moved between the FIGS. 8 and 10 positions.

Figure 11:
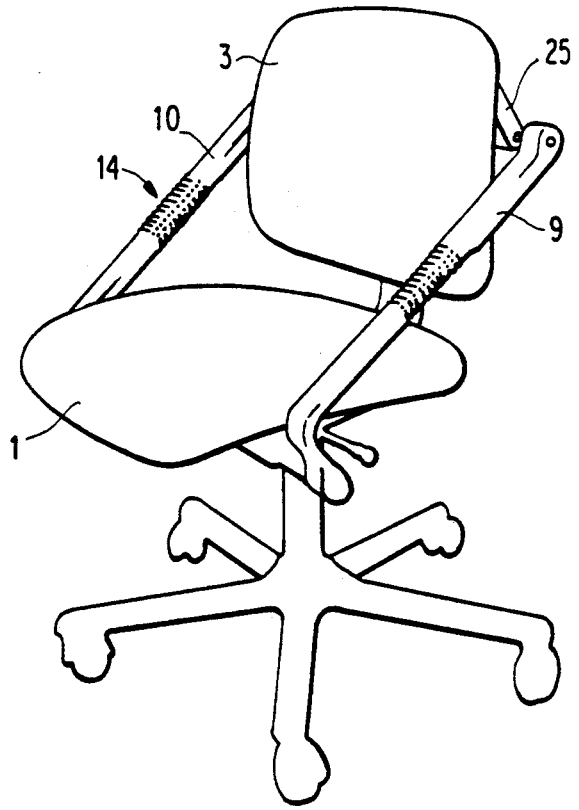
FIG. 11 is a perspective view of a chair according to yet another embodiment of the invention.
Figure 12:
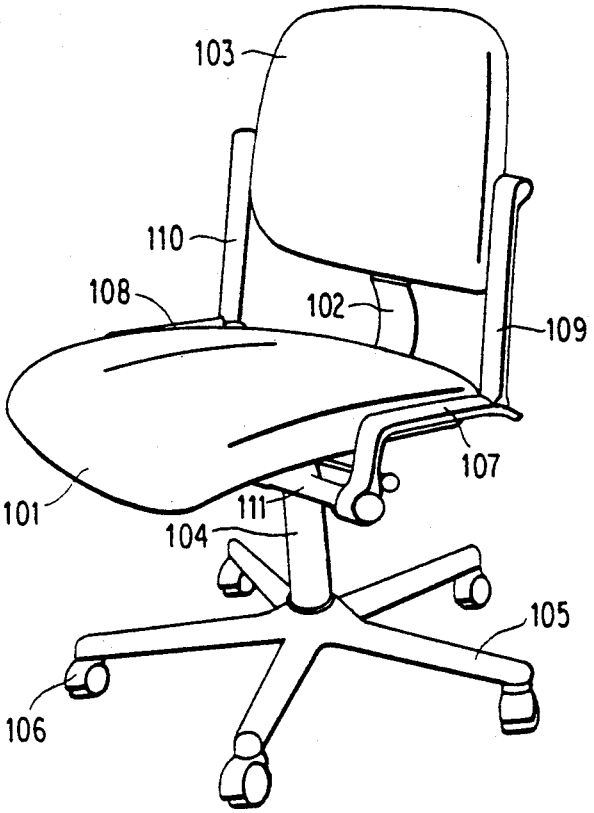
FIGS. 12 through 17 are perspective views of a chair according to a still further embodiment of the invention.

A somewhat similar arrangement is illustrated in FIG. 11, wherein the distal ends of the arm rests 9, 10 are pivoted directly to support arms 25, which are in turn hinged to the rear of the back rest 3 by means of a plate or the like. Here again, the slots or slide grooves 15 in the arm rests may be dispensed with.

Figure 13:
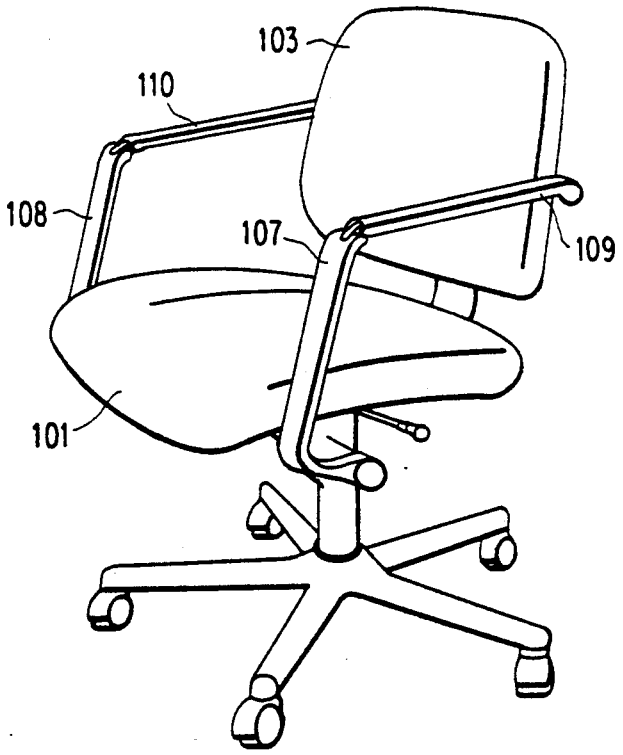
Figure 14:
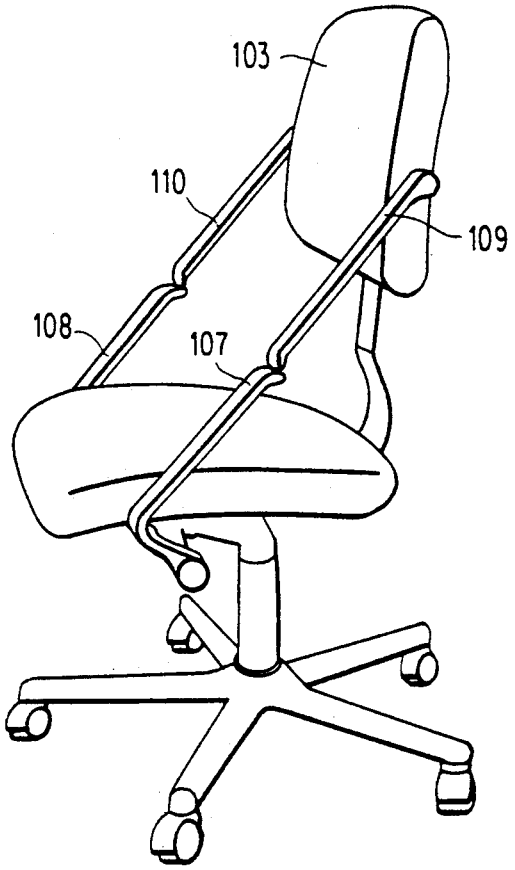
Figure 15:
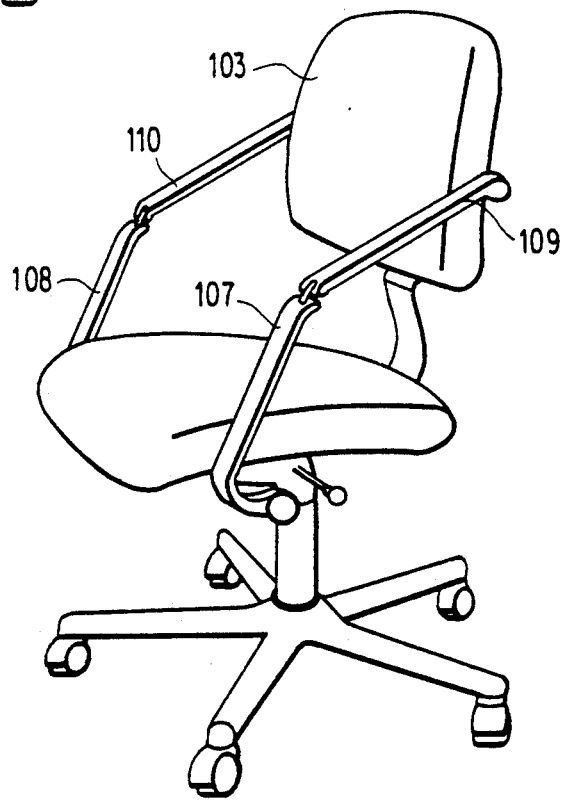

The further embodiment shown in FIGS. 12–15 comprises a pivotally hinged seat holder mounting a seat 101 and a back rest 103 slidably fitted to a bar strap 102. The seat holder is supported by a seat carrier in a pedestal 104 having five spider feet 105 provided with casters 106. Support members 107, 108 have their lower or distal ends bent downwardly and inwardly at approximately right angles, and they are pivotally mounted to a shaft 111 disposed on the seat holder. The arm rests 109, 110 are articulated to the support members by simple hinges, and their distal ends are pivotally mounted directly to the back rest 103. i.e. without any guide groove and sliding rod arrangement. Due to the dimensions of the various components, when the arm rest units are in the collapsed position shown in FIG. 12 the back rest 103 is raised slightly above the seat. To move the arm rest unite from the collapsed position of FIG. 12 to the raised position of FIG. 13, the back rest 103 is moved upwardly as shown in FIG. 14 until the support members and arm rests extend in a straight line, whereafter the hinges or articulations are pulled forwardly and the back rest is lowered, as shown in FIG. 15, until the FIG. 13 configuration is arrived at.

Figure 16:
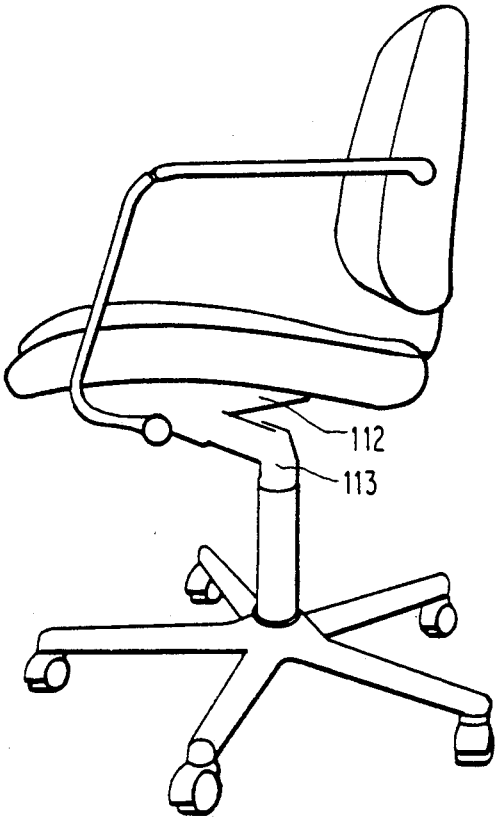

FIG. 16 is similar to FIG. 13, but illustrates the seat holder 112 and the seat carrier 113. Once again, since the construction of these components is well known in the art they are not described in detail.

Figure 17:
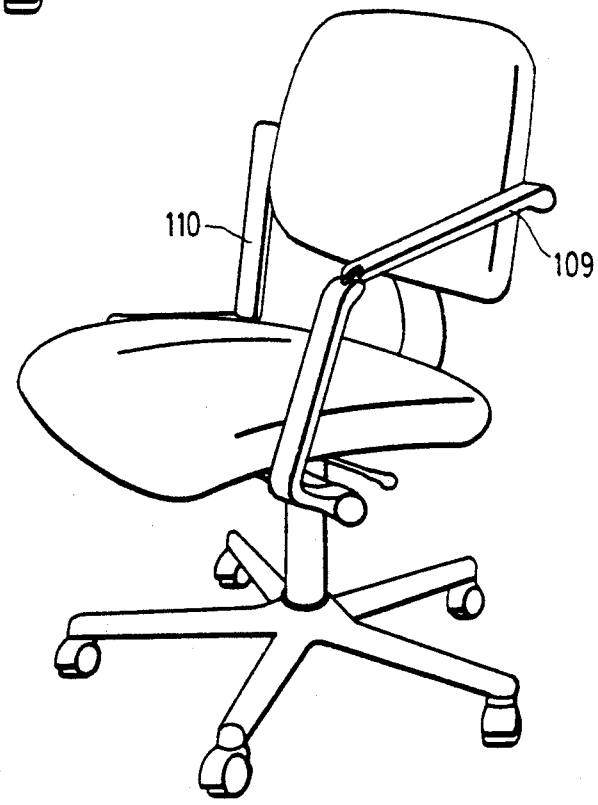

FIG. 17 is similar to FIG. 5, and simply illustrates that the arm rests 109, 110 of the FIGS. 12–15 embodiment can be individually disposed in respective collapsed and raised positions.

We claim:

1. A chair, comprising:

a seat unit;

a back rest secured to the seat unit;

at least one side unit including a support member and an arm rest, proximal ends of the support member and the arm rest being articulated together, a distal end of the support member being bent downwardly relative to a collapsed position of the side unit whereat the support member and arm rest lie alongside the seat and back rest, respectively, at an angle of from 70° to 90°, and said distal end being pivotally mounted to the seat unit below a seat thereof; and means pivotally mounting a distal end of the arm rest to a side of the back rest, wherein the side unit can be displaced between said collapsed position, and a raised position whereat the support member and arm rest are substantially perpendicular to the seat and back rest, respectively.

2. A chair as claimed in claim 1, wherein there are two side units respectively disposed on left and right sides of the chair.

3. A chair as claimed in claim 2, wherein the distal ends of the support members are pivotally mounted to the seat unit via a rotatable horizontal shaft.

4. A chair as claimed in claim 2, wherein the support members are individually articulated to the arm rests by elongate metal straps.

5. A chair as claimed in claim 4, wherein the straps are embedded in a molded component forming the support members and arm rests.

6. A chair as claimed in claim 2, wherein the support members are individually articulated to the arm rests by hinge joints.

7. A chair as claimed in claim 2, wherein the pivotal mounting means comprises elongate guide slots individually formed in inner sides of the arm rests, and bolts individually outstanding from sides of the back rest and slidably disposed in the slots.

8. A chair as claimed in claim 7, wherein each slot defines a plurality of recesses forming seats for the bolts.

9. A chair as claimed in claim 2, wherein the pivotal mounting means comprises a pair of support arms each having one end pivotally coupled to a distal end of an arm rest and another, opposite end pivotally mounted to a rear side of the back rest.

10. A chair as claimed in claim 2, wherein the distal ends of the arm rests are directly pivotally mounted to sides of the back rest, and the back rest is vertically movable to enable the displacement of the side units between the collapsed and raised position.

11. A chair as claimed in claim 1, comprising a seat and a back rest and a vertically adjustable head rest mounted to the back rest by support rods so that the distal ends of the arm rests can be pivoted directly to the rods and such that the rods can slide upwardly and then back down again when the arm rest units are moved between the collapsed position and the raised position.

12. A chair as claimed in claim 1, wherein the distal end of the support member has a length approximately equal to $\frac{1}{3}$ of the length of the proximal end of the support member.

* * * * *